US009552685B1

(12) United States Patent
Itkis et al.

(10) Patent No.: US 9,552,685 B1
(45) **Date of Patent: *Jan. 24, 2017**

(54) AUTOMATIC BALL BLOWER

(71) Applicant: FORTUNET, INC., Las Vegas, NV (US)

(72) Inventors: Yuri Itkis, Las Vegas, NV (US); Leo Schpak, Las Vegas, NV (US); Valeri Tsaturyan, Las Vegas, NV (US)

(73) Assignee: Fortunet, Inc., Las Vegas, NV (US)

( * ) Notice: Subject to any disclaimer, the term of this patent is extended or adjusted under 35 U.S.C. 154(b) by 187 days.

This patent is subject to a terminal disclaimer.

(21) Appl. No.: 13/793,678

(22) Filed: Mar. 11, 2013

(51) Int. Cl.
*G07C 15/00* (2006.01)

(52) U.S. Cl.
CPC ..... *G07C 15/001* (2013.01)

(58) Field of Classification Search
CPC ..... A63F 7/048; G07C 15/001
USPC ..... 273/144
See application file for complete search history.

(56) References Cited

U.S. PATENT DOCUMENTS

| | | | | | |
|---|---|---|---|---|---|
| 1,151,661 | A * | 8/1915 | Caskey | 417/286 |
| 4,583,736 | A * | 4/1986 | Lorraine | 273/144 B |
| 4,741,533 | A * | 5/1988 | Michael | 273/144 B |
| 4,861,032 | A * | 8/1989 | Gaylor | 273/144 B |
| 5,121,920 | A * | 6/1992 | Laezzo et al. | 273/144 B |
| 5,372,621 | A * | 12/1994 | Staton et al. | |
| 5,401,034 | A * | 3/1995 | Mallinger | 473/576 |
| 5,590,879 | A * | 1/1997 | Tripp | 273/144 R |
| 5,935,516 | A * | 8/1999 | Baugh | 422/1 |
| 5,945,655 | A * | 8/1999 | Gilgeous et al. | 235/454 |
| 6,120,024 | A * | 9/2000 | Lind | 273/144 R |
| 7,191,489 | B1 * | 3/2007 | Heath | 15/320 |
| 7,537,520 | B2 * | 5/2009 | Campo et al. | 463/19 |
| 7,775,521 | B1 * | 8/2010 | Itkis et al. | 273/144 B |
| 8,113,516 | B2 * | 2/2012 | Jones | 273/144 R |
| 8,128,608 | B2 * | 3/2012 | Thevenin | 604/347 |
| 8,235,388 | B1 * | 8/2012 | Itkis et al. | 273/144 A |
| 8,257,204 | B1 * | 9/2012 | Liu et al. | 473/460 |
| 8,766,633 | B2 * | 7/2014 | Bhattacharya et al. | 324/309 |
| 8,777,711 | B2 * | 7/2014 | Seelig et al. | 463/16 |
| 2001/0032396 | A1 * | 10/2001 | Toshima et al. | 34/444 |
| 2007/0108700 | A1 * | 5/2007 | Bigelow | 273/138.1 |

* cited by examiner

*Primary Examiner* — Michael Dennis
*Assistant Examiner* — Dolores Collins
(74) *Attorney, Agent, or Firm* — FisherBroyles, LLP; Rob L. Phillips

(57) ABSTRACT

A transparent, automatic ball blower configured to generate random outcomes for a game by air-mixing Ping-Pong-style balls in a mixing chamber. During game play, the balls extracted from the mixing chamber via an extractor pipe are subsequently carried by a computer-controlled, motorized ball carrier mechanism to an inlet of a ball accumulator compartment. The ball accumulator compartment may be located proximate to the ball mixing chamber. The ball carrier mechanism moves and drops the extracted balls, one-at-a-time, into the ball accumulator compartment. The balls fall into the ball accumulator compartment by means of gravity alone. The balls fill the ball accumulator compartment which, in one version, accommodates a single vertical layer of balls allowing visual inspection of the balls. At the end of game play, the balls are released from the ball accumulator compartment into the mixing chamber through a computer-controlled, motorized ball release gate.

17 Claims, 5 Drawing Sheets

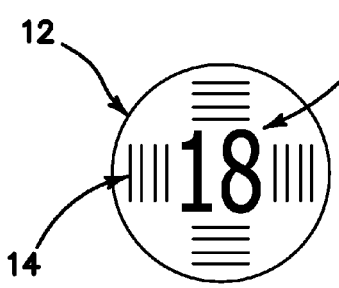
FIG. 2
FIG 3
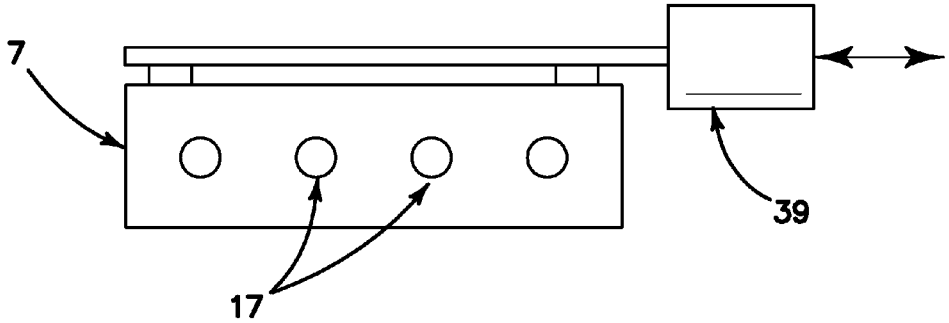
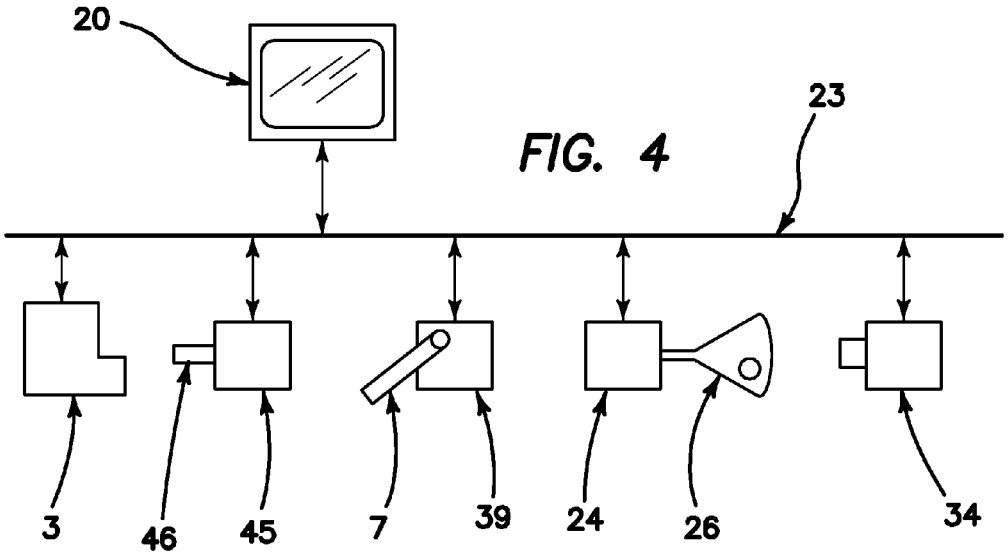
FIG. 4

AUTOMATIC BALL BLOWER

FIELD OF THE INVENTION

The embodiments of the present invention relate to a hands-free, automatic ball blower.

BACKGROUND

U.S. Pat. No. 7,775,521 (to Itkis, et al.), incorporated herein by this reference for all purposes, discloses an automatic ball blower including a pressurized ball return tube that sequentially accumulates balls drawn from the ball-mixing chamber during a gambling game, such as bingo, keno and lottery, and releases the accumulated balls into the mixing chamber at the end of the game. The balls extracted from the mixing chamber during the game are carried, one-at-a-time, by a computer-controlled, motorized carriage towards the inlet of the ball return tube. Although the ball return tube surrounding the mixing chamber, like a staircase, preserves the valuable history of the balls drawn during the game, it substantially increases the cost of the automatic ball blower, and requires a separate, auxiliary pump for a controlled pressurization of the ball return tube that, unfortunately, increases the level of noise generated by the automatic ball blower.

Accordingly, it would be advantageous to simplify an automatic ball blower; reduce the noise generated by an automatic ball blower; and also reduce the cost of an automatic ball blower while providing all of the desired benefits.

SUMMARY

Accordingly, in one embodiment, the automatic ball blower does not include a ball return tube or auxiliary pump, and instead, replaces the expensive ball return tube and auxiliary pump with an inexpensive ball accumulator compartment placed proximate to the ball mixing chamber. In one embodiment, the ball accumulator compartment and ball mixing chamber share a common wall. During play of a game, a computer-controlled, motorized ball carriage picks-up the balls at the outlet of a ball extractor pipe positioned near a center of the ball mixing chamber and drops or releases the balls at an inlet of a ball accumulator compartment configured to accommodate a single layer of balls. The balls then free-fall, one-at-a-time, into the ball accumulator compartment gradually filling the ball accumulator compartment. At the end of the game, the balls collected in the ball accumulator compartment are released into the mixing chamber through a computer-controlled, motorized ball release gate.

Other variations, embodiments and features of the present invention will become evident from the following detailed description, drawings and claims.

BRIEF DESCRIPTION OF THE DRAWINGS

FIG. 2 illustrates a barcoded ball for use with the automatic ball blower according to the embodiments of the present invention;

FIG. 3 illustrates a ball return gate with ventilation openings according embodiments of the present invention;

FIG. 4 illustrates a block diagram of computer-controlled automatic ball blower according to the embodiments of the present invention;

DETAILED DESCRIPTION

Figure 1:
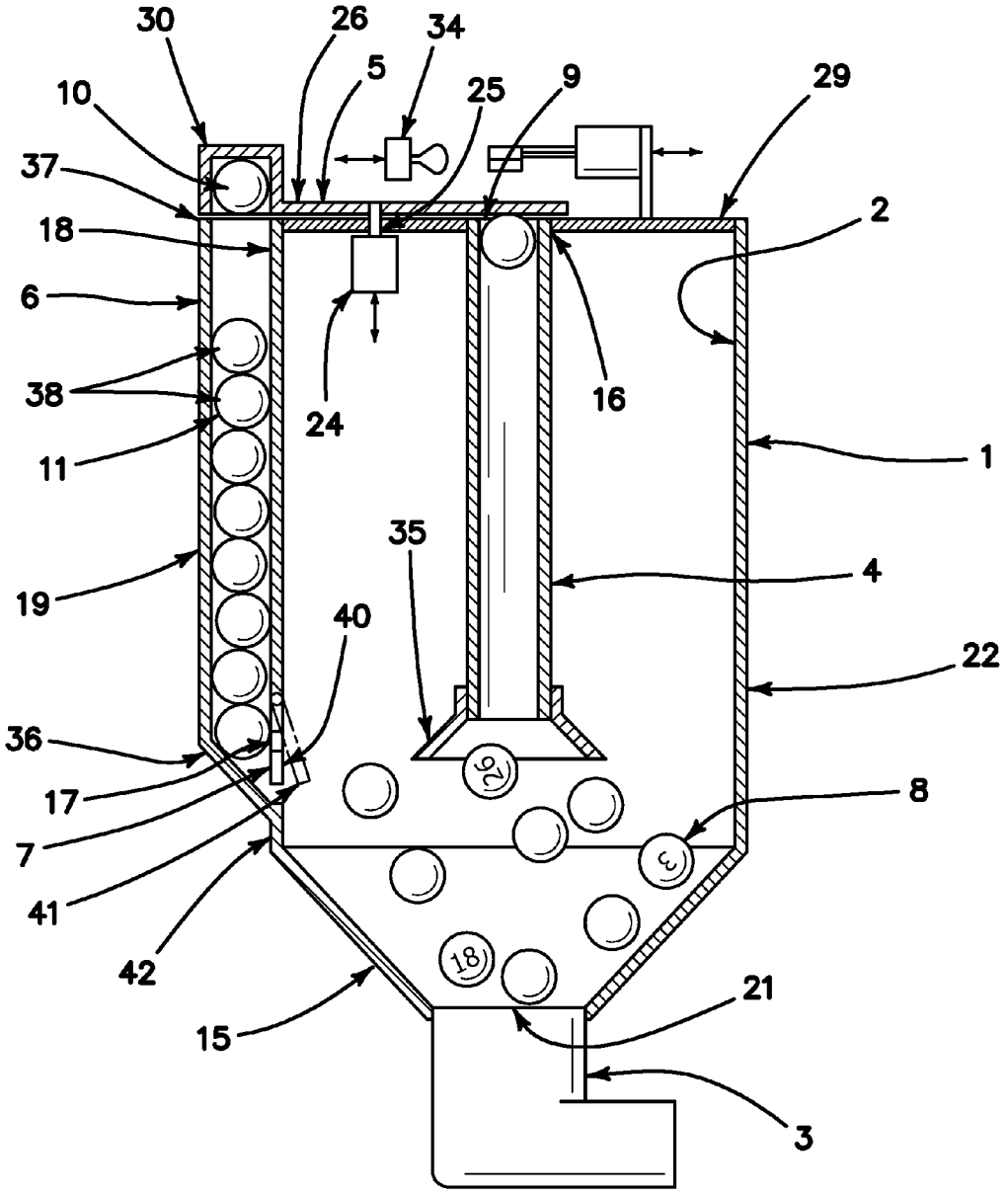
FIG. 1 illustrates a cross-sectional side view of an automatic ball blower according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to those skilled in the relevant art and having possession of this disclosure, are to be considered within the scope of the invention claimed.

The components of the embodiments of the present invention may be fabricated of any suitable materials, including plastics, alloys, composites and may be fabricated using suitable techniques, including molding, casting, machining and rapid prototyping.

FIG. 1 shows a cross-sectional side view of an automatic ball blower 1 having a ball mixing chamber 2, air pump 3, ball extractor pipe 4, ball carrier mechanism 5, ball accumulator compartment 6 and ball return gate 7. The ball mixing chamber 2, ball extractor pipe 4, ball carrier mechanism 5 and ball return gate 7 are, in one embodiment, manufactured of a transparent durable plastic, such as acrylic, thereby exposing balls 8 through 11 contained therein for external observation. As shown in FIG. 2, the balls 8 through 11 are, in one embodiment, manufactured as Ping-Pong balls imprinted with identification numbers and/or symbols and barcodes 14. Therefore, the ball 12 is identified by a ball number 13 and/or a barcode 14. The ball blower 1 is configured to generate random game outcomes, such as the identities of the randomly drawn balls, for gambling games, such as bingo, keno and lottery.

The air pump 3 is attached to a bottom pan 15 of the automatic ball blower 1. An air-driven mixing chamber 2 is, in one embodiment, constructed as a rectangular, transparent vertically standing box (those skilled in the art will recognize that the air mixing chamber may be constructed in a variety of shapes and forms including spherical and cylindrical forms). During play of a game, the air pump 3 blows air into the mixing chamber 2 to stir balls 8 contained in the mixing chamber 2. In one embodiment, a vertical ball extractor pipe 4 is located at the center of the mixing chamber 2. One end 16 of the ball extractor pipe 4 is attached to a top cover 29 of the mixing chamber 2. In one embodiment, the mixing chamber 2 is sealed, except that the pressurized air injected by the air pump 3 is able to escape from the mixing chamber 2 through a top end 16 of the ball extractor pipe 4 and ventilation openings 17 in the ball return gate 7 as best illustrated in FIG. 3.

A vertical wall 18 of the mixing chamber 2 is, in one embodiment, a common wall with the vertical ball accumulator compartment 6. In one embodiment, the vertical ball accumulator compartment 6 is made of a transparent plastic material. An external wall 19 of the ball accumulator compartment 6 is, in one embodiment, parallel to the common wall 18, which together define the ball accumulator compartment 6 in which the balls 11 extracted from the mixing chamber 2 are accumulated during play of the game.

The air pump 3 is controlled by a computer 20 as illustrated in FIG. 4. Under the control of the computer 20, the pump 3 is "on" during the play of the game and is "off" when the game is over. When in an on position, the pump 3 blows pressurized air into the mixing chamber 2 through an opening 21 at the bottom pan 15 of the mixing chamber 2. The pressurized air forces the balls 8 contained in the mixing chamber 2 to agitate/mix by bouncing off one other and ricocheting off walls 22 of the mixing chamber 2, including the common wall 18, and also the ball extractor pipe 4.

Figure 5:
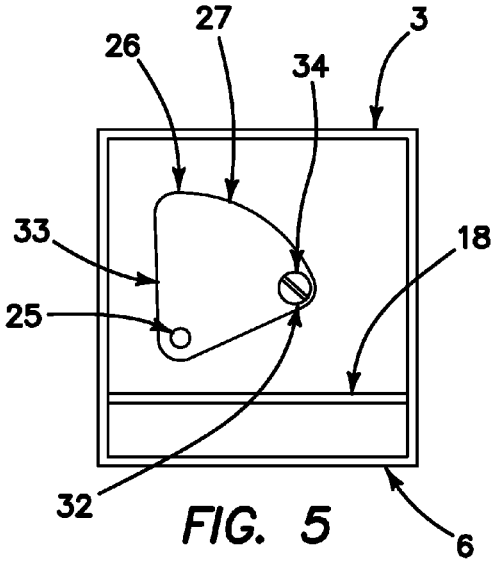
FIG. 5 illustrates a top down view of a ball carrier with a ball socket positioned above an outlet of a ball extractor pipe according to the embodiments of the present invention.
Figure 6:
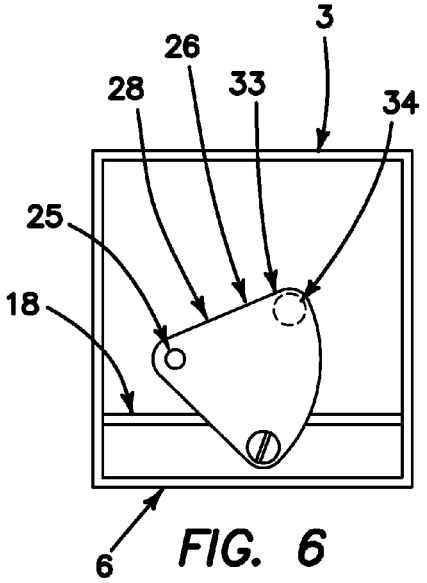
FIG. 6 illustrates a top down view of the ball carrier with the ball socket positioned above an inlet of a ball accumulator compartment according to the embodiments of the present invention.

In one embodiment, the computer 20 controls the air pump 3 through a USB bus 23. Through the same bus 23, the computer 20 also controls a motor 24, such as a stepper motor, of the ball carrier mechanism 5 mounted on the axis 25 of the motor 24. One element of the ball carrier mechanism 5 is a carriage plate 26 that is, in one embodiment, shaped as a sector/segment of a circle centered on the axis 25 as best illustrated in FIGS. 5 and 6. The plate 26 rotates between two positions, namely, a ball pick-up position 27 and a ball drop position 28 as illustrated in FIGS. 5 and 6, respectively. The ball carrier mechanism 5 includes a ball socket 30 mounted on the plate 26. The ball socket 30 is shaped as a short transparent pipe 31 (in one embodiment having the same diameter as the extractor pipe 4) capable of accommodating a single ball. The short pipe 31 is opened at its bottom end 32 to allow a single ball 8 being mixed in the mixing chamber 2 to enter the ball socket 30 when the latter is positioned in the ball pick-up position 27 over the extractor pipe 4. While the socket 30 is positioned in the pick-up position 27, the pressurized air escapes through a mostly open top end of the short pipe 31. The top end of the short pipe 31 is partially blocked, in one embodiment, by two narrow, transparent rods 32 parallel to each other and securely attached across the top end of the short pipe 31. The rods 32 prevent the ball 10 positioned within the socket 30 from escaping the automatic ball blower 1 into the open air under the pressure of the air streaming through the top (open) end 16 of the extractor pipe 4.

Figure 7:
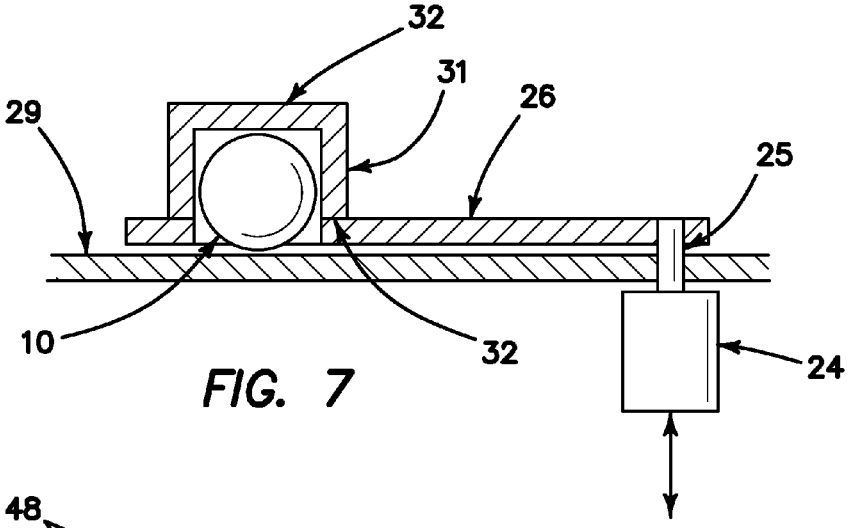
FIG. 7 illustrates a side view of the automatic ball blower with the ball carrier in a position to drop a ball into the accumulator compartment according to the embodiments of the present invention.

Under the air pressure developed by the air pump 3, at least one of the balls 8 being mixed in the mixing chamber 2 is pushed into the ball socket 30 when the latter is positioned at the ball pick-up position 27, over the top end 16 of the extractor pipe 4 as best illustrated in FIG. 7.

Once the ball 10 is in the socket 30, positioned at the ball pick-up position 27, a video camera 34 captures an image of the ball 10 and transmits the captured image to the computer 20. The computer 20 processes the captured image using an optical character recognition routine and/or barcode 14 reading routines to identify the ball 10 and thereafter command the motor 24 to rotate the plate 26 from the ball pick-up position 27 to the ball drop-off position 28. As the plate 26 rotates, it carries the socket 30 mounted thereupon, and the latter carries the ball 10 by rolling the ball 10 over the horizontal top cover 29 of the ball mixing chamber 2. Once the socket 30 arrives at the ball drop-off position 28, the ball 10 drops from the socket 30 under the force of gravity and continues to free fall into the ball accumulator compartment 6 since the air pressure of the air stream escaping from the extractor pipe 4 is insufficient to levitate the ball 10 in the socket 30 positioned at the ball drop-off position 28.

In one embodiment, while the socket 30 is positioned at the drop-off position 28, a tail edge 33 of the plate 26 covers the top opening 34 of the extractor pipe 4 preventing any additional ball 9 from escaping the extractor pipe 4 into the open air. An additional advantage of the tail edge 33 covering the top opening 34 is a reduction in the air pressure drop between the bottom edge 35 and the top edge 16 of the extractor pipe 4. Such a reduction in the air pressure generally prevents any additional balls 8 from entering into the extractor pipe 4 and also facilitates the dropping (i.e., out of the extractor pipe 4) of any balls 9 that may already be inside of the extractor pipe 4. Applicant has learned that having the extractor pipe 4 essentially empty, while the socket 30 is above the ball drop-off position 28, results in a more random ball mixing and facilitates security of play of the game.

Under the control of computer 20, the socket 30 transports balls 8 from the mixing chamber 2, one-at-a-time, into the ball accumulator compartment 6. The transported balls 10 fall into the ball accumulator compartment 6 on top of one another and gradually fill the compartment 6, starting from its inclined bottom plate 36 and stacking to the top 37 of the vertical ball accumulator compartment 6. The balls 11 contained in the accumulator compartment 6 are unable to exit the ball accumulator compartment 6 while the ball return gate 7, located at the bottom of the ball accumulator compartment 6, is closed.

Figure 8:
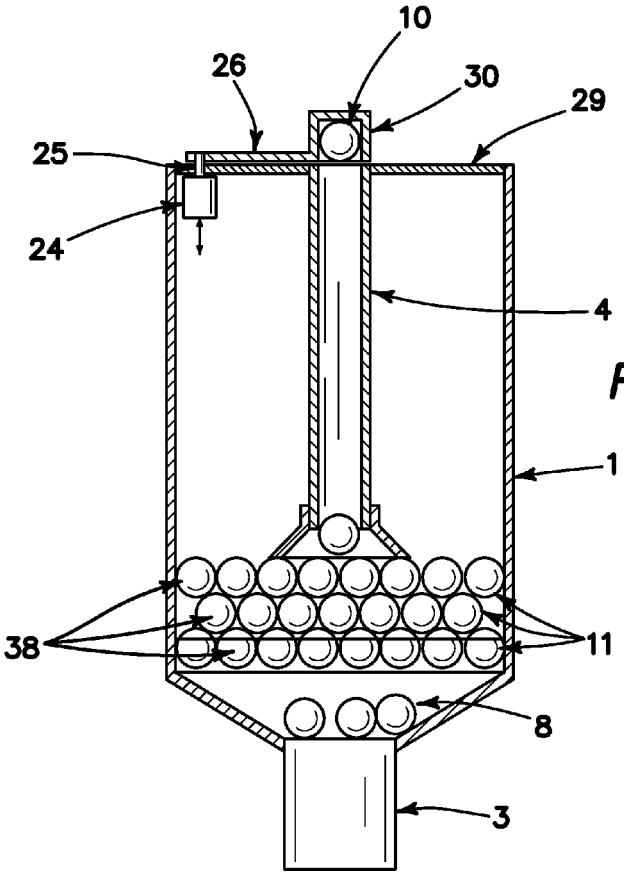
FIG. 8 illustrates a cross-sectional back view of the automatic ball blower according to the embodiments of the present invention.

The ball accumulator compartment 6 should have a ball capacity sufficient for the game being played. For example, with a classic keno game, it is sufficient to have the ball accumulator compartment 6 configured to accommodate twenty balls, while for a classic bingo game, the ball accumulator compartment 6 is configured to accommodate seventy-five or ninety balls. In one embodiment, the ball accumulator compartment 6 takes a substantially rectangular form with a space defined by the external wall 19 and the common internal wall 18 selected to be slightly larger than the diameter of the Ping-Pong balls 12 resulting in the balls 11 being stacked in the ball accumulator compartment 6 in a single vertical stack 38 comprising multiple columns as illustrated in FIGS. 1 and 8. For example, if the balls 11 are stacked vertically in columns averaging eight balls 11 and horizontally in rows averaging ten balls 11, the ball accumulator compartment 6 is configured to hold eighty balls 11.

Applicant has learned that the balls 11 dropped in the ball accumulator compartment 6 generally do not form a perfect rectangular ball structure, but rather tend to form an irregularly shaped pyramid-like ball structure. Such a phenomenon implies that the ball accumulator compartment 6 should have a sufficient vertical dimension to accommodate a required number of balls 11. Applicant has further learned that the openings 17 in the return gate 7 can provide for a partial escape of the pressurized air from the mixing chamber 2 into the bottom of the ball accumulator compartment 6 which tends to "shake-up" the balls 11 in the accumulator compartment 6 facilitating a more uniform and preferred settling down of the balls 11 in the ball accumulator compartment 6 thereby preventing pyramid-like ball stacking which does not maximize the defined space of the ball accumulator compartment 6. Due to the openings 17 (and also partially due to the air escaping from the mixing chamber 2 near edges of the gate 7), the overall height of the mixing chamber 2 may be substantially decreased resulting in a lower overall cost of the ball blower.

In another embodiment, the ball accumulator compartment 6 may include vertical separators to assist with the proper stacking of the balls 11 therein. In such an embodiment, the computer 20 may instruct the ball carrier mechanism 5 to move to multiple drop positions so that balls 10 drop into a selected one of the multiple separate columns formed by the vertical separators.

The ball return gate 7 is, in one embodiment, driven by a motor 39, such as a stepper motor, between a normally closed vertical position 40 and an open position 41 (as indicated in FIG. 1 by dashed lines). Being closed during the game, the ball return gate 7 prevents balls 11 from rolling down the inclined bottom 36 into the mixing chamber 2. Once the game is over, the computer 20 commands the motor 39 to open the return gate 7 so that the balls 11 accumulated in the ball accumulator compartment 6 fall through (due to gravity) the ball accumulator compartment 6 and over the inclined bottom plate 36 through the open gate 7 and into the mixing chamber 2. In one embodiment, to facilitate the return of the balls 11 into the mixing chamber 2, at the end of the game, the computer 20 shuts down the air pump 3 or reduces the pressure of the air being distributed by the air pump 3.

Applicant has also learned that it is desirable to have the bottom edge of ball return gate 7 located at a height 42, slightly above the bottom pan 15 of the mixing chamber 2, to facilitate a full discharge of the balls 11 from the ball accumulator compartment 6 into the mixing chamber 2 without interference from the balls 8 contained in the mixing chamber 2.

Figure 11:
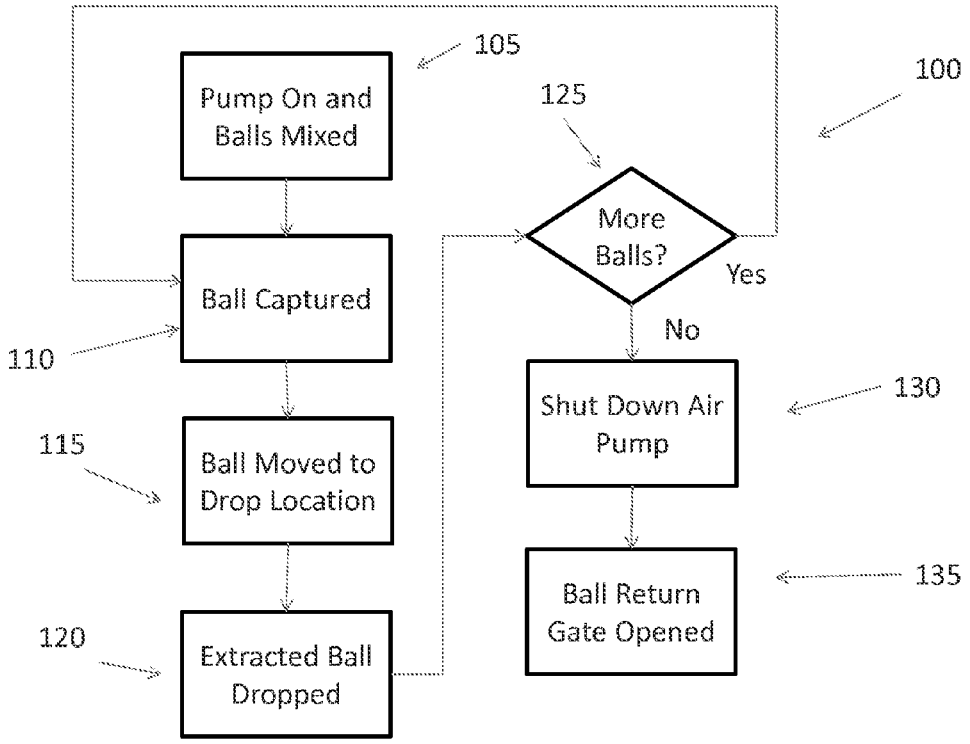
FIG. 11 illustrates a flow chart of a game methodology facilitated by the automatic ball blower according to the embodiments of the present invention.

FIG. 11 shows a flow chart 100 detailing a game methodology facilitated by the automatic ball blower 1. At 105, the air pump 3 is turned on and the balls 8 are mixed in the mixing chamber 2. At 110, a ball 8 from the mixing chamber 2 is captured by the extractor pipe 4. At 115, the ball carrier mechanism 5 moves the captured ball 10 from the pick-up location to the drop location. At 120, the ball 10 is dropped into the ball accumulator compartment 6. At 125, it is determined if additional balls need to be drawn. If so, the flow chart 100 loops back to 110. If not, at 130, the computer 20 may optionally shut down the air pump 3. At 135, the computer 20 causes the ball return gate 7 to open releasing the balls 11 from the ball accumulator compartment 6 into the mixing chamber 2.

The above-described embodiment of the automatic ball blower 1 is not the only possible implementation of the principles of the present invention. The invention may be implemented in many various ways by a person skilled in the art. For example, the ball accumulator compartment 6 may be (i) detached from the mixing compartment; and/or (ii) inclined rather than substantially vertical; and/or (iii) at least partially spherical and/or may accumulate balls 11 not in a single layer 38 but in two or more layers, especially if it is acceptable, in a particular application, not to expose each and every ball accumulated in the ball accumulator compartment 6 for a direct view but rather sufficient to rely on the history of the drawn balls stored in the memory of computer 20 (thus allowing the height of the ball accumulator compartment 6 to be reduced to store the required number of balls 11). In addition, different shapes and forms of the ball accumulator compartment 6 may result in a more complex (rather than the straight vertical line trajectories of the balls dropping down from the ball socket 30) design and may involve various paths and height differences.

Figure 10:
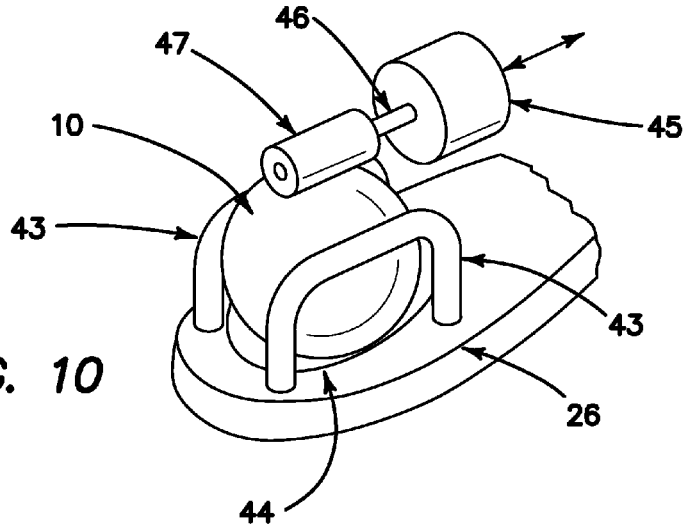
FIG. 10 illustrates an alternative implementation of a ball socket according to the embodiments of the present invention.

Similarly, the socket 30 retaining the ball 10 while it is being extracted and transported may be implemented in various shapes and forms, as long as it performs the primary functions of (i) capturing the ball 10 at the ball pick-up position; (ii) retaining the ball 10 while it rolls over the top cover 29 of the mixing chamber 2; and (iii) allowing the ball 10 to drop into the ball accumulator compartment 6 at the ball drop-off position 28. In particular, as shown in FIG. 10, the socket 30 may be effectively implemented as two parallel u-shaped brackets 43 mounted on top of the carrier plate 26 and surrounding the ball inlet/outlet opening 44 at the bottom of the plate 26 through which the ball 10 is picked-up and dropped. The brackets 43 prevent the ball 10 at the ball pick-up position 27 from escaping into the open air under the pressure of the air streaming through the top opening 34 of the extractor pipe 4. The same brackets 44 however do not prevent ball 10 from dropping into the ball accumulator compartment 6 at the drop position 28 where the effect of the air streaming from the extractor pipe 4 is negligible.

Applicant has learned that the ball 10 contained in the socket 30 (whether it is implemented as a short pipe 31 or parallel brackets 44) tends to rotate and vibrate erratically due to air pressure turbulences. The erratic motion of the ball 10 complicates and slows down the process associated with reading the ball identity by the camera 34 and the computer 20. It is desirable therefore, to mount a constant-speed motor 45 (also controlled by the computer 20) on top of the mixing chamber 2 in such a way that the motor's axis 46 is positioned slightly above and between the brackets 44, in such a way that the friction between the axis 46 and the ball 10 facilitates a regular, orderly rotation of the ball 10. It is further desirable to provide for friction between the axis 46 and the ball 10 (e.g., by putting a chunk of a rubber hose 47 on the axis 46 as illustrated in FIG. 10).

Figure 9:
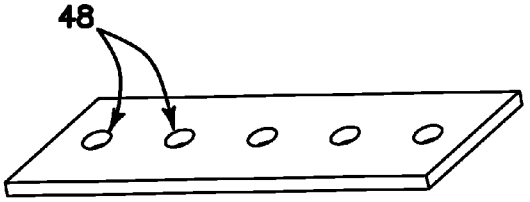
FIG. 9 illustrates an inclined bottom plate of the ball accumulator compartment with ventilation openings therein according to the embodiments of the present invention.

Applicant has also learned, like ventilation openings 17 in the ball return gate 7, it is desirable to add ventilation openings 48 in the inclined bottom plate 36 of the ball accumulator compartment 6 as illustrated in FIG. 9. The ventilation openings 48 further facilitate the process of settling down of the first few balls 11 in the ball accumulator compartment 6.

Although the invention has been described in detail with reference to several embodiments, additional variations and modifications exist within the scope and spirit of the invention as described and defined in the following claims.

We claim:

1. A ball blower comprising:

an air pump configured to supply pressurized air for mixing a plurality of balls in a mixing chamber;

a ball extractor pipe configured to extract, one-at-a-time, one or more of the plurality of balls from the mixing chamber by means of the pressurized air;

a ball carrier mechanism configured to capture, transport and release balls, one-at-a-time, extracted from the mixing chamber by the ball extractor pipe into a ball accumulator compartment, wherein the balls released into the ball accumulator compartment by the ball carrier mechanism fall into the ball accumulator compartment by means of gravity and without assistance by a source of air pressure, said ball carrier mechanism configured to rotate along an upper surface of the mixing chamber between the ball extractor pipe and the ball accumulator compartment to roll captured balls extracted via the extractor pipe along an upper surface of a top cover of the mixing chamber to a drop location over the ball accumulator compartment; and a ball return gate configured to hold the balls accumulated in the ball accumulator compartment during game play and release the balls accumulated in the ball accumulator compartment into the mixing chamber at the end of game play.

2. The ball blower of claim 1, wherein the balls released by the ball return gate roll down through an open ball return gate into the mixing chamber.

3. The ball blower of claim 1, wherein the ball accumulator compartment allows the balls accumulated therein to be visually identified.

4. The ball blower of claim 1, wherein the ball accumulator compartment accumulates the balls in substantially one vertical layer comprising multiple columns.

5. The ball blower of claim 1, wherein the ball return gate is configured to permit pressurized air from the mixing chamber into the ball accumulator compartment.

6. The ball blower of claim 1 further including a motorized frictional element configured to cause a controlled rotation of the balls extracted from the mixing chamber.

7. The ball blower of claim 1, wherein a bottom of the ball accumulator compartment is inclined to facilitate a release of the balls from the ball accumulator compartment into the mixing chamber.

8. The ball blower of claim 1, wherein the ball return gate is mounted at a height above a bottom pan of the mixing chamber to facilitate return of the balls into the mixing chamber without interference of balls in the mixing chamber.

9. The ball blower of claim 1, wherein the ball return gate is configured to allow for the simultaneous release of multiple balls from the ball accumulator compartment into the mixing chamber.

10. The ball blower of claim 1 further comprising a computer for controlling one or more of the following: air pump, ball carrier and ball return gate.

11. The ball blower of claim 1, further comprising machine-recognizing means for identifying the balls.

12. The ball blower of claim 1, further including a motor configured to cause the balls being extracted from the mixing chamber by the ball extractor pipe to rotate at a controlled speed based on friction.

13. The ball blower of claim 1, further including a video camera configured to capture images of the balls extracted from the mixing chamber via the ball extractor pipe.

14. The ball blower of claim 1, wherein the ball accumulator compartment is proximate to the mixing chamber whereby the ball accumulator compartment and the mixing chamber share a common wall.

15. The ball blower of claim 1, wherein the mixing chamber and ball accumulator compartment are substantially transparent.

16. The ball blower of claim 1, wherein the ball carrier mechanism is configured to prevent balls extracted from the mixing chamber via the extractor pipe from escaping the extractor pipe.

17. The ball blower of claim 1, wherein a portion of the ball carrier mechanism covers an outlet of the ball extractor pipe when the ball carrier is in a ball drop location.

* * * * *